United States Patent [19]

Wood

[11] 4,103,452

[45] Aug. 1, 1978

[54] CHILD'S TELEPHONE APPARATUS

[76] Inventor: Richard G. Wood, 857 E. 3rd South, Salt Lake City, Utah 84102

[21] Appl. No.: 750,006

[22] Filed: Dec. 13, 1976

[51] Int. Cl.[2] ..... A63H 33/30

[52] U.S. Cl. ..... 46/33; 46/232

[58] Field of Search ..... 46/33, 232; 179/100 L, 179/81 B, 6 R

[56] References Cited

U.S. PATENT DOCUMENTS

| | | | |
|---|---|---|---|
| 2,578,367 | 7/1949 | Mott | 179/84 T |
| 2,808,463 | 10/1957 | Jenkins et al. | 179/84 T |
| 3,238,644 | 3/1966 | Hayes | 46/33 X |
| 3,769,744 | 11/1973 | Sloane, Jr. et al. | 46/33 |
| 3,953,680 | 4/1976 | Zimmermann | 179/6 E |

FOREIGN PATENT DOCUMENTS

| | | | |
|---|---|---|---|
| 1,117,810 | 1/1968 | United Kingdom | 179/100 L |

*Primary Examiner*—Russell R. Kinsey
*Assistant Examiner*—Mickey Yu

[57] ABSTRACT

Telephone apparatus for children which is selectively connectible to home stereophonic sound systems, by way of example. The subject telephone is a talking toy telephone which utilizes a stereophonic sound system requiring a play-back on two separate speakers. One of the speakers is mounted on the base of the telephone and the other speaker is enclosed within a receiver portion of the handset. The tape or record utilized in external apparatus includes two stereophonic channels, one being utilized for a telephone ring which is reproduced by the base speaker of the telephone, and a second channel including numerous type of information which is played back at the handset speaker.

5 Claims, 8 Drawing Figures

CHILD'S TELEPHONE APPARATUS

FIELD OF INVENTION

The present invention relates to toy telephones, and more particularly, to new and improved telephone apparatus usable by children for their education and/or entertainment.

DESCRIPTION OF PRIOR ART

Certain other types of toy telephones have heretofore been developed and are described in the following United States patents:

U.S. Pat. No. 3,080,679
U.S. Pat. No. 3,238,644
U.S. Pat. No. 3,287,849
U.S. Pat. No. 3,382,604
U.S. Pat. No. 3,422,566
U.S. Pat. No. 3,594,941
U.S. Pat. No. 3,769,744
U.S. Pat. No. 3,912,694

The devices as described in such patents are suitable only for simple functions, and many of these are quite expensive to manufacture. There appears to be no provision in such art for the utilization of external, conventional stereophonic equipment wherein one channel can be used to accomplish one function as, for example, to produce a ring, whereas the other channel is used to reproduce a message transmission and/or sound effects at a separate area of the telephone.

BRIEF SUMMARY OF THE INVENTION

In the present invention a toy telephone includes a speaker in the handset and also a speaker in the base of the telephone. Each speaker is activated independently by independent channels by prerecorded tape or record which is played on external equipment. Only one speaker is activated at a time. Provision is made for cut-off of the base speaker upon lifting the handset and, correspondingly, for cut-off of the handset speaker upon resetting the same in its cradle. Reciprocating switch means is provided and is engageable by the handset for accomplishing these functions. Spring-loaded push-buttons are provided to simulate push-button dialing; alternately, another embodiment may utilize a rotary dial. Novel switch means are provided for making certain electrical connections. The telephone is provided with any one of several alternate means for coupling to selected output terminals of a stereo sound unit, be the same a record player or a tape player.

OBJECTS

Accordingly, a principal object is to provide a new and improved toy telephone.

A further object is to provide for a new, educational and/or entertainment system for children.

A further object is to provide a toy telephone in which switch means is automatically actuated for selection of one of two speakers in the telephone, depending upon usage and manipulation.

A further object is to provide equipment for reproducing stereophonic recordings wherein one type of information is contained on one channel, and another type of information is contained on the other channel.

A further object is to simulate actual telephone communications equipment for children, and this automatically, without the aid of an operator, parent, or other adult.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

Figure 1:
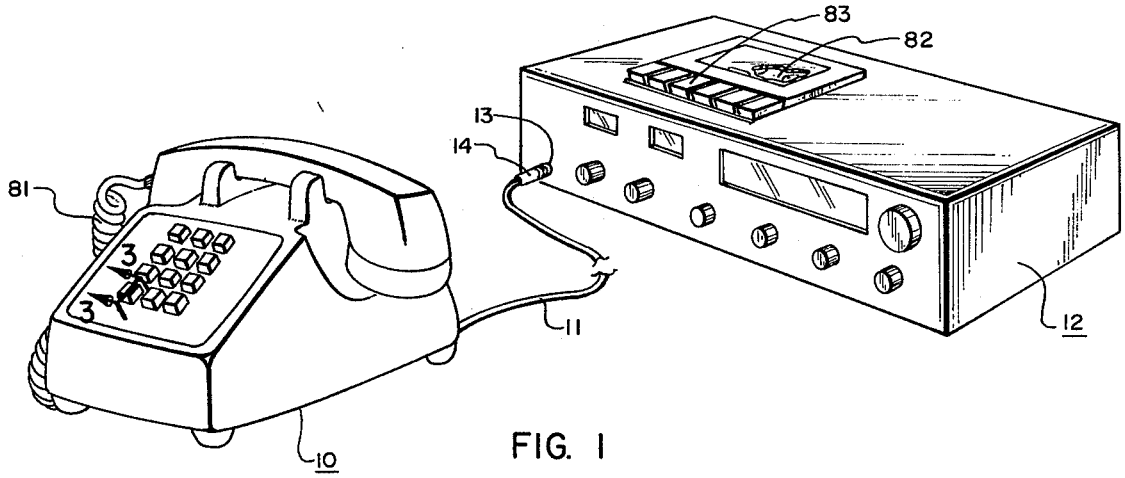
FIG. 1 is a perspecitve view of a toy telephone and stereo sound unit utilizing the same.

In FIG. 1, the toy telephone 10 of the present invention is shown provided with a 3-conductor cord 11 leading to stereo sound unit 12 such as a record player or tape recorder/player. Unit 12 is provided with at least one output jack 13, which receives stereo phone plug 14, the latter being electrically and physically connected to the 3-conductor cord 11. In common parlance, the plug 14 is generally referred to as a stereophonic headphone plug. In one form of the invention the plug 14 will be inserted in the stereophonic headphone jack 13 normally supplied in a stereo sound unit.

Figure 2:
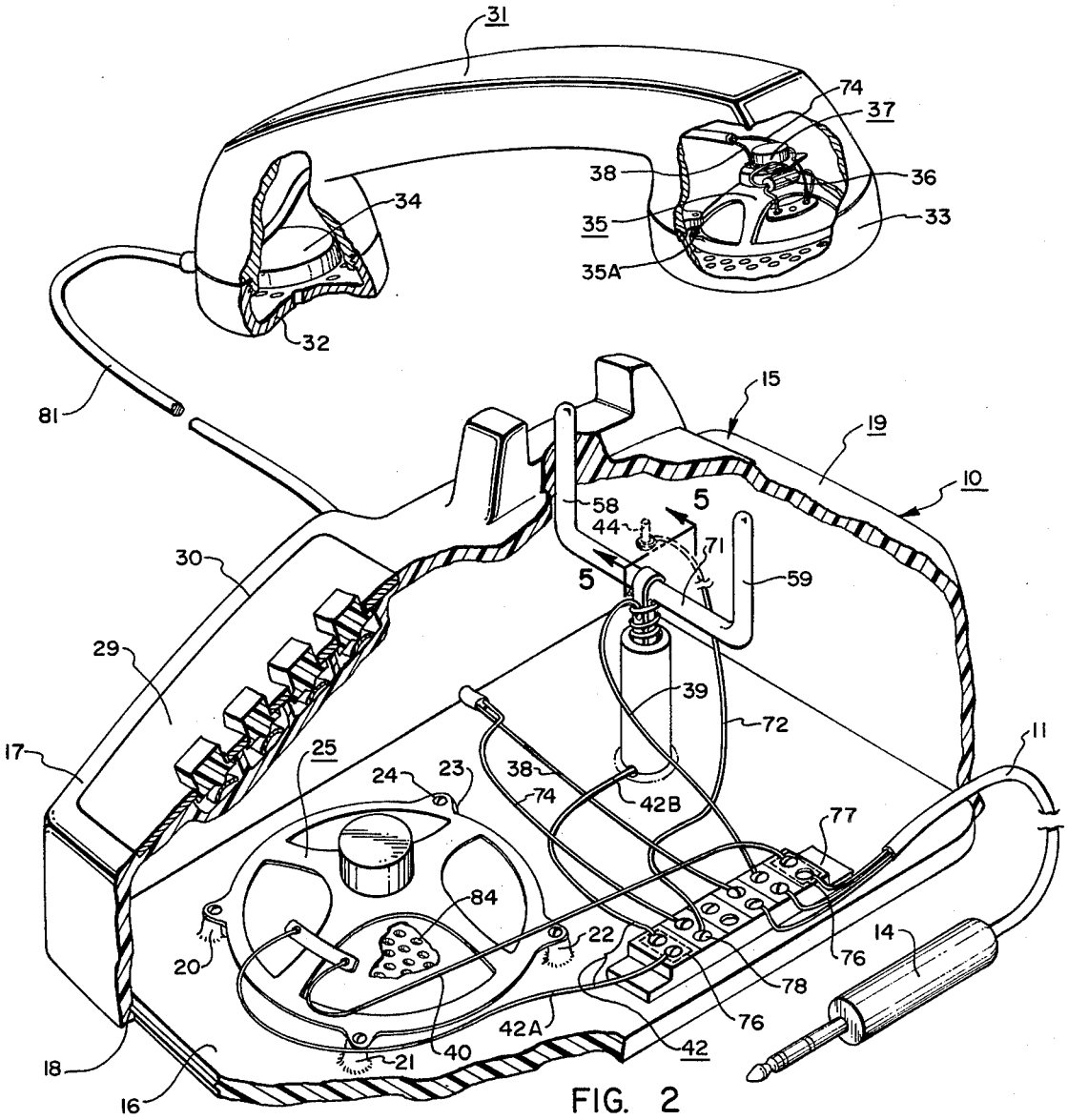
FIG. 2 is an enlarged fragmentary perspective of the telephone of FIG. 1, indicating the internal construction of the handset and also the telephone base.

As to the toy telephone 10, the same is shown to include a telephone base 15, the latter comprising a base member 16 and a cover 17 secured thereover as shown in FIG. 2. Cover 17 may be secured to base member 16 by screws, by a detent at 18, or by any other conventional means.

Base member 16 is provided with upstanding attachment bosses 20–23 which are drilled and tapped to receive screw attachments 24. The same is utilized to mount the speaker 25 into the position shown in FIG. 2 The speaker may be selected from those having normally a $3\frac{1}{2}$ inches diameter, and having the characteristics of 2-watt output 8 ohm impedance. It will be seen in FIG. 2 that base member 16 and cover 17 make up a composite housing 19 for the telephone base 15.

Figure 3:
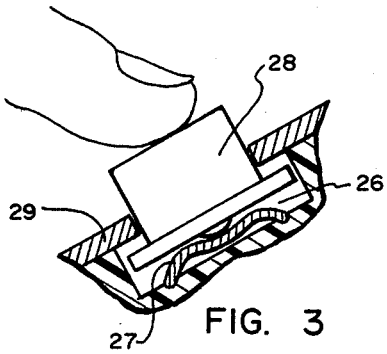
FIG. 3 is an enlarged fragmentary detail, principally in section, and taken along the line 3—3 in FIG. 1.
Figure 4:
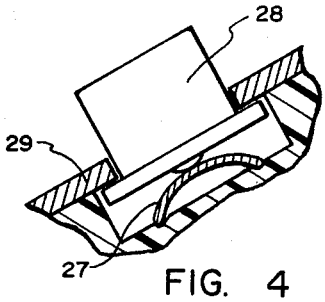
FIG. 4 is similar to FIG. 3 by illustrating the push-button as being returned by its spring once finger pressure against the button, as shown in FIG. 3, is removed.

Cover 17 is provided with a series of depressions 26, normally twelve, the same being provided with resilient, bubble-type springs 27 which supply an outer restoring force to each of the several "dialing" push-buttons 28. These push-buttons will be electronically and functionally inoperative; however, the child using the phone will get the "feel" of true telephone operation by selectively depressing these buttons as may be instructed, as hereinafter explained, and thereafter release the buttons so that the same will return from the position shown in FIG. 3 to the initial position shown in FIG. 4.

To mount and retain the buttons a mask 29 may be employed and snapped in place at a snap detent 30 in the usual manner as in the case of conventional telephones. Other types of securement can be employed.

The handset 31 of the toy telephone, see FIG. 2, includes a mouthpiece portion 32, a receiving portion 33, and is provided with cord 81 as shown. Mouthpiece portion 32 will include a counter weight 34, of no functional purpose other than to offer a balance to the handset 31 by counterbalancing the speaker 35 that is mounted by screws or other means 35A to the interior of receiving portion 33. Any type of press-fit or retentive mounting, of course, may be employed in connection with the mounting of speaker 35. The speaker 35 itself, see FIG. 6, may include capacitor 36 and potentiometer 37, the latter which is preset at the factory for optimum speaker performance. The speaker may be selected from those having normally a $1\frac{3}{4}$ inches diameter, and having the characteristics of 0.1 watt output 8 ohm impedance.

Figure 6:
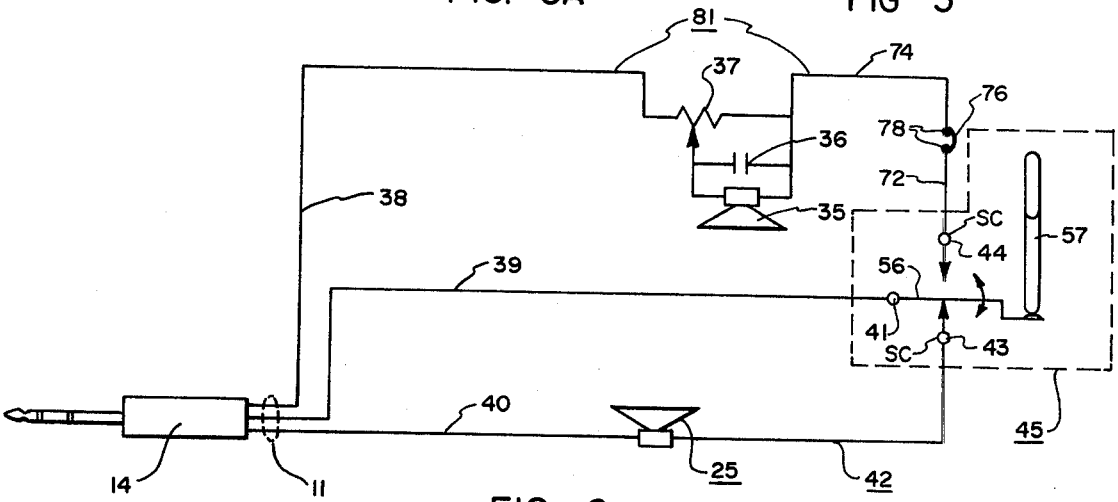
FIG. 6 is a wiring schematic of the electrical circuit of the invention, illustrating its operation.

FIG. 6 illustrates an electrical schematic of the circuit used in connection with this invention. The plug 14, see also FIG. 1, is shown as is also the 3-conductor cable 11. Each of the electrical leads 38–40 respectively connected to potentiometer 37, to switch terminal 41 and also to speaker 25. The remaining side of speaker 25 is coupled by lead 42 to switch contact 43. Switch contacts 43, 44, and terminal screw 41 are in fact part of the switch means 45, the same also including switch connector means 56. The position of switch means 45 is shown in FIG. 6 corresponding to the handset-in cradle position.

Figure 5A:
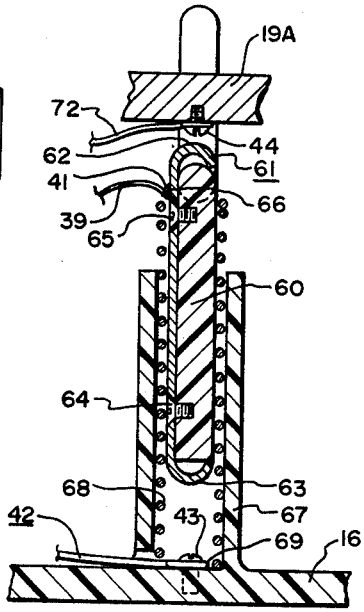
FIG. 5A is a transverse vertical section taken along the line 5A—5A in FIG. 5.
Figure 5:
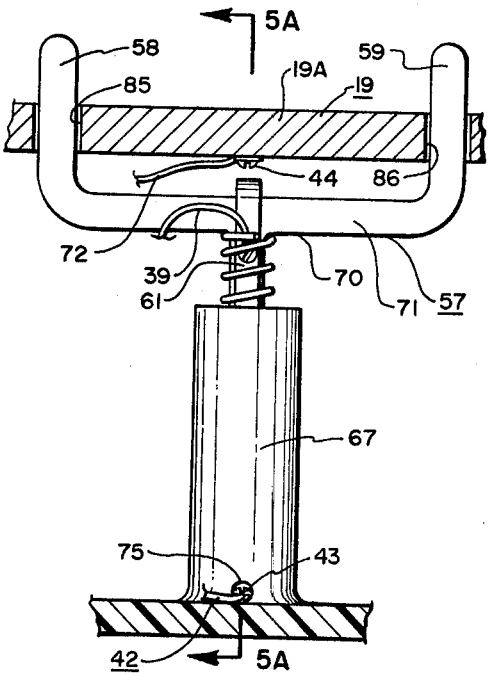
FIG. 5 is an enlarged front elevation of the double-prong switch means utilized in the invention, the same being selectively actuated by the handset.

Switch member 57 is generally Y-configured, made of a plastic insulative material, and includes a pair of upstanding actuation prongs 58 and 59 joined by crossbar 71 which is integral with an upstanding leg 60. Prongs 58 and 59 proceed through apertures 85, 86 of base portion 19A. Leg 60 is provided with an electrically conductive, spring-tempered copper strip 61 which is doubled back at its extremities 62 and 63 and retained in position by such screws 64 and 65. Switch contact 44 is seen in FIG. 5A and also in FIG. 6. Correspondingly, switch contact 43 is shown in FIGS. 5A and 6. Conductive strip 61 is shown schematically as its functional equivalent, "switch arm" 56, which follows the up-and-down movement of switch member 57. Terminal screw 41, see FIGS. 5A and 6, is secured at 66 to the aforementioned conductive strip and supplies electrical connection for lead 39. Electrical connection may be made by solder menas, by crimping, by a conductive screw, or by other suitable means.

It is noted that the base member 16 is provided with an upstanding sleeve boss 67, the same having aperture 75, for passage of lead 42, and also being provided with an internal compression spring 68. The compression spring seats against the bottom 69, generally, and its upper extremity engages the upper surface 70 of crossbar 71 of the switch member 57.

From an electrical standpoint, the wire segments 42A and 42B of FIG. 2, shorted by one of the representative bus bar segments 76 of terminal strip 77, will comprise the composite lead or connector 42 seen in FIG. 6. Kindly note FIG. 2 in this regard.

The terminal strip 77 includes a plural pairs of terminal strip screws 78, individual pairs of which are electrically connected together by any suitable conductive means. The respective pairs of screws, that is screws disposed directly across from each other in FIG. 2 are, of course, not connected to any other pair. For desirability and ease of contact, it is desirous that the ends 62 and 63 of the conductive strip be curved as indicated, this to provide for some resiliency or "give" as these ends engage the respective screw terminals 43 and 44 in FIG. 5A.

Switch contact 44 is provided with conductive lead 72 and this is illustrated in FIG. 2.

The operation and over-all description of the structure is as follows:

Unit 12 in FIG. 1 is representative of many stereo sound units that may be employed to operate the toy telephone. Such units may comprise a record player and/or tape player.

The stereo sound unit 12 in any event will include a start or play button 83 and, in the embodiment shown, will have a replaceable cassette 82. In accordance with the principles of the invention, that is, whether a record or a tape is employed, there will be recorded on such record or tape, for example, on one channel, a telephone ring sound which is audibly similar to that which one hears when his own telephone rings. On the other channel, and after the recording of the telephone ring sound, there will appear a voice recording of a given fantasy character, for example. In fact, on the remaining channel there can be a series of messages which the child will be able to receive. The type of recording on the tape or record can vary, of course; one type will best be understood by reference to the following description of operation, giving primary attention to the toy telephone handset and base.

Toy telephone 10 will preferably be placed at some remote point from unit 12, and a parent will put the record or tape into play by turning the unit 12 on to "play" position. At some future point in time, generally a very brief time interval, the telephone ring recorded on one channel of the record or tape will be reproduced in speaker 25 It is noted that speaker 25 is directly connected to unit 12 through the 3-conductor cable 11 and that the ring will be received by the telephone base speaker 25 only when the handset 31 is down so as to depress the switch member 57 such that there exists an electrical connection between terminal screw 43 through the conductive strip 61 to lead 39. At this point then, the child hears the ring and will be prompted to pick up the handset. When he does so, then the switch member 57, being under the pressure of compression spring 68, will lift upwardly so as to break contact between the conductive strip 61 and switch contact 43. Also, at this point, there is a connection now as between conductor 39 and conductor 72, this via the uppermost curved portion 62 of conductive strip 61. This action serves to cut off the lower speaker 25, by virture of the disconnection of conductive screw 43 with the bottom of the conductive strip 61, and produces a completion of the circuit relative to speaker 35 of handset 31. It is noted in FIG. 2 that lead 72 is connected through the terminal strip 77 to lead 74, see FIGS. 2 and 6.

Thus, the child continues to listen but this time, instead of hearing the telephone ring, will hear a recorded message or instruction from the "telephone operator," or fantasy character.

The "telephone operator" may indicate to the child that he will shortly receive a telephone call from a fantasy character, in which event the child will return the handset to the cradle to receive the next telephone ring on the first channel.

It will be understood that there are many types of sounds that can be employed on either one or both channels. As to a preferred embodiment of the invention herein, however, the ring known as the conventional "audible ring," audible to a calling party, will appear solely on the second or message channel to actuate speaker 35. The "telephone ring" signal, on the first channel, will actuate solely the speaker 25 in the telephone base in FIG. 2 to indicate that a call is being received.

In sum, and to recapitulate, one channel will include the usual "audible ring," i.e. that ring which is heard by a user when he has just placed a call. Also this channel will include voices, background, and so forth. The "telephone ring," i.e. that heard when one is receiving a call will be recorded on the remaining channel.

Figure 7:
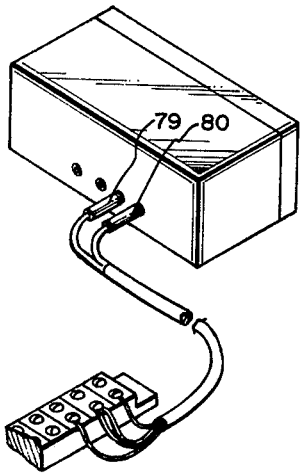
FIG. 7 is a perspective view in reduced scale of an alternate means of electrical connection from the toy telephone to an external stereo unit.

It wil be understood that rather than prerecorded fantasy character voices, there may be voices "from the past" so that a child may figuratively talk to Abraham Lincoln, Alexander Graham Bell, as so forth. Additionally, other types of audible information may be recorded on one or both channels of the tape or record, but generally one, for a variety of instructional and/or entertainment purposes. There are several optional and alternate ways of making connection to the stereo sound unit. One way, of course, is shown in FIG. 1 wherein connection is made to the stereophonic headphone jack 13. Another way is shown in FIG. 7 wherein RCA-type phono plugs 79 and 80 can be employed in connection with the 2-conductor cables and inserted in the right and left speaker jacks. Optionally, though not shown, is the fact that connection can be made directly to the solderless speaker screw terminals if present on the sound unit, in which case the plugs 79 and 80 in FIG. 7 would be replaced by solderless lugs.

The following observations are made in connection with the subject toy telephone and its system.

Telephone programs intended for use can be recorded on standard 33⅓ and 45 rpm phonograph records, standard cassettes, cartridge tapes, and open-reel recording tapes. Whatever the medium of recording used on this stereo sound unit, the toy telephone herein is a "talking" telephone which utilizes a stereophonic sound system requiring in any event that the sound be recorded on two independent channels. One of the channels contains periodic recordings of a telephone ring; the other contains recorded speech and sound effects, including periodic recordings of an "audible ring," i.e. the ring-signal heard through a conventional telephone when one is placing a telephone call.

As to playback of the program by the toy telephone herein, the initial ring is heard on the base speaker of the telephone When the child lifts the handset then this base speaker is cut off and the message comes through the speaker in the handset. Should the "operator" instruct a child to "dial" a number, and the child does so, then the "message" channel can give the "audible ring," which may be prerecorded on the tape or record to simulate a phone call being placed.

It is to be noted that in most stereophonic sound systems there is a slight amount of "cross-talk" from one channel to another. Such "cross-talk," however, will normally not be detectable while operating the toy telephone herein.

It is noted that the subject telephone elminates conventional problems of (1) poor-quality sound reproductions, (2) recordings of limited duration, (3) necessity of continuous remote operation, (4) battery operation, and (5) large expense. Thus, existing sophisticated sound equipment can be used to play the messages, such that the child will receive high-quality sound reproductions of, e.g. long-playing records.

A large number of American families already own stereophonic sound equipment capable of operating the subject toy telephone. No special adaption is required and no inconvenience created; rather, a stereophonic, programmed record or tape is simply put into play on the external machine so that the child may enjoy it at a point remote therefrom by use of his telephone herein.

It should be noted that when the volume level of the sound system utilized is adequate to play recorded speech and sound effects through the handset speaker, it may be inadequate to effectively produce the telephone ring through the base speaker. This volume level problem is or may be overcome by recording the ring at the greatest possible level without causing serious distortion in the playback, recording the speech and sound effects on the other channel at a normal volume level, and utilizing a potentiometer in the handset speaker, as at 37 in FIG. 2, so as to reduce the speaker's volume capacity. It is noted that the perforated base at 84 maximizes the volume of the "telephone ring," allowing the sound to pass freely from the telephone housing enclosure. Background noise in the sound system can be filtered from the handset speaker by means of capacitor 36 in FIG. 2.

It is noted that the switch means 57 operates to open one speaker circuit and close the other speaker circuit, and vice versa. The same, again, is operated by engagement of the actuation prongs 58 and 59 by the handset.

The toy telephone of the present invention is, of course, intended for connection to any standard sound system which will include but not be limited to standard playback units utilizing 33⅓ and 45 rpm phonograph records, cassettes, 8-track cartridges, and open-reel recording tapes.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A toy telephone having a handset and a base coupled to and selectively supporting said handset, said handset being provided with a first speaker, said base being provided with a second speaker, and first means for coupling separate channels from an external, audio-signal stereo playback unit to respective ones of said speakers.

2. The structure of claim 1 wherein said toy telephone includes switch means coupled to said first means for coupling a particular one of said speakers to said first means at a particular time.

3. In combination, a toy telephone having two speakers, a stereo, audio-signal reproducing unit having first menas for producing a prerecorded telephone ring signal and second means for producing a prerecorded message, said toy telephone having third means for coupling said first means to one of said speakers and fourth means for coupling said second means to the remaining speaker.

4. The structure of claim 3 wherein said toy telephone has a base and a handset coupled thereto, one of said speakers being disposed at said base, the remaining speaker being disposed at said handset, said first means being selectively coupled to said one speaker, and said second means being coupled to said remaining speaker.

5. The structure of claim 4 wherein said toy telephone includes switch means carried by said base and actuated by said handset for effecting said selective coupling of said first means to said one speaker.

* * * * *